US008854271B2

(12) United States Patent
Cox et al.

(10) Patent No.: US 8,854,271 B2
(45) Date of Patent: Oct. 7, 2014

(54) DATA RECEIVING APPARATUS

(75) Inventors: Gavin Cox, Lancashire (GB); Derek Grice, Lancashire (GB)

(73) Assignee: Raven Manufacturing Limited, Accrington, Lancashire (GB)

( * ) Notice: Subject to any disclaimer, the term of this patent is extended or adjusted under 35 U.S.C. 154(b) by 566 days.

(21) Appl. No.: 12/996,299

(22) PCT Filed: May 29, 2009

(86) PCT No.: PCT/GB2009/001350

§ 371 (c)(1), (2), (4) Date: Apr. 1, 2011

(87) PCT Pub. No.: WO2009/147376

PCT Pub. Date: Dec. 10, 2009

(65) Prior Publication Data

US 2011/0175786 A1 Jul. 21, 2011

(30) Foreign Application Priority Data

Jun. 3, 2008 (GB) ..... 0810075.2

(51) Int. Cl.
*H01Q 3/00* (2006.01)

(52) U.S. Cl.
USPC ..... 343/757; 343/840; 343/909

(58) Field of Classification Search
USPC ..... 343/757, 835, 839, 840, 909
See application file for complete search history.

(56) References Cited

U.S. PATENT DOCUMENTS 3,769,623 A * 10/1973 Fletcher et al. ..... 343/909
3,953,858 A * 4/1976 Ohm ..... 343/779
4,342,036 A 7/1982 Scott et al.
6,075,497 A * 6/2000 Chen et al. ..... 343/840
6,219,003 B1 * 4/2001 Chandler ..... 343/779
6,433,752 B1 8/2002 Moncada et al.
6,512,485 B2 * 1/2003 Luly et al. ..... 343/781 CA
7,839,348 B2 * 11/2010 Baker ..... 343/757
8,248,318 B2 * 8/2012 Wahlberg et al. ..... 343/762
8,362,963 B2 * 1/2013 Rakotoarisoa et al. ..... 343/757
2002/0140617 A1 * 10/2002 Luly et al. ..... 343/781 CA

FOREIGN PATENT DOCUMENTS

WO WO 02/073740 A1 9/2002

OTHER PUBLICATIONS

Herren J.J."Dichroic Multilayer Structures Theoretical and Experimental Study" L'Onde Electrique, Editions Chiron S.A. Paris, FR, vol. 73; No. 1,Jan. 1, 1993, p. 49-52.

R. Ravanelli et al; "21/44 GHz Multifeed Dual Contoured Beam Antenna Using Frequency Selective Surface" MM Conf. Brighton, Oct. 14-15, 1992, Microwave Pub, GB, vol. 9, p. 243-245.

* cited by examiner

*Primary Examiner* — Tho G Phan
(74) *Attorney, Agent, or Firm* — Gable Gotwals

(57) ABSTRACT

This invention is directed toward a data signal receiving means including an antenna and a plurality of Low Noise Blocks (LNB's). A reflective filtering means is provided and located with respect to the LNBs and antenna such that data signals received at a first frequency or frequency range pass through the reflective filter means to a first LNB and data signals at second frequency or frequency range are deflected by the reflective filtering means and do not pass therethrough and pass to the second LNB. In this way a single antenna can be used to receive and process multiple data signals received at different frequencies or frequency ranges.

17 Claims, 3 Drawing Sheets

DATA RECEIVING APPARATUS

CROSS-REFERENCE TO RELATED APPLICATIONS

This application is the United States National Phase of PCT Patent Application No. GB2009/001350 filed on 29 May 2009, which was published in English on 10 Dec. 2009 under Publication No. WO 2009/147376 A1, which claims priority to British Patent Application No. 0810075.2 filed 3 Jun. 2008, both of which are incorporated herein by reference.

The invention which is the subject of this application relates to apparatus for use in the reception of data, and typically data transmitted and received from one or a plurality of satellites. The invention relates to the reception and the subsequent processing of the data to allow services such as television or radio channels or internet and/or other auxiliary services to be provided to a user of the apparatus. The invention also relates to apparatus for receiving the data and which is also capable of transmitting data.

The provision of satellite data transmission systems is well known and typically comprises one or more satellites which are used to receive data from broadcast locations and then transmit the data onto a plurality of premises. Each of the premises, or groups of premises, is provided with an antenna which is typically a dish shaped device with which is mounted one or more Low Noise Blocks (LNBs). The Low Noise Blocks are connected to processing means typically provided within the premises which allow the data received via the antenna and LNB to be decoded and which then allows the required range of services to be available for user selection.

The current invention relates to a satellite antenna arrangement and is aimed at allowing the antenna to be provided in a format which allows multiple data signals to be received simultaneously such that an increased quantity of data can be received by the same common antenna. One known form of apparatus of this type is that described in patent application WO02073740 in which the apparatus includes a multi-band reflector antenna which is provided with a main reflector defining a prime focus and a frequency selective surface sub-reflector defining an image focus. An LNB can be provided at the main reflector prime and a second LNB can be provided at the sub reflector image focus therefore providing the means for two different data signals at different frequencies to be received, one by the main reflector, and the other by the sub reflector focus. Additional LNBs can also be placed at spaced locations from the sub reflector to receive data from a plurality of transmitting satellites.

However it has been found that the manufacture of the type of apparatus described in this known patent document is difficult to achieve accurately and uniformly in terms of the signal quality and quality of the service which can be achieved. It has also been found that due to the difficulties in manufacture of the components that interference of the received data signals at the different frequencies can cause problems.

An alternative solution would be to provide two satellite antennas, one provided to receive the data signals at a first frequency and the other to provide the data signals at a second frequency. However the mounting of two antennas at a premises is regarded as impractical and would generally be resisted by users concerned about the external appearance of their premises.

An aim of the present invention is therefore to provide a single satellite antenna which can be used to receive data signals at two frequency ranges and to allow the reception of the data signals to be sufficiently good in terms of quality so as to allow the received data signals to be subsequently processed and the services provided to the user at a desired quality level. A further ain is to allow the data to be received and/or transmitted in a form which is acceptable in terms of quality and which allows the same to be subsequently processed with no or acceptable error rates.

In a first aspect of the invention there is provided a satellite antenna wherein said antenna includes first and second Low Noise Blocks (LNB's) provided to receive data signals in first and second frequency ranges respectively and wherein said antenna further includes a reflective filtering means which allows data signals at a first frequency or in a first frequency range to pass therethrough to the first LNB and data signals at a second frequency or in a second frequency range to be deflected to the second LNB.

Typically the location of the respective LNBs is such that one is offset with respect to the other.

In one embodiment the second LNB is mounted at a side or on the centre line of the antenna. In one embodiment further LNBs can be positioned adjacent thereto.

Typically the first LNB is mounted such that the reflective filtering means lies between the antenna surface and the first LNB. Once more, further LNBs can be mounted adjacent thereto.

In one embodiment the type and/or design of the reflective filtering means is provided with regard to specified predetermined frequency ranges for data signals which are to be received by the antenna to which the reflective filtering means is to be fitted.

In one embodiment the reflective filtering means allow the higher value frequency range data signal to pass through the same and the lower value frequency range data signal to be deflected.

In one embodiment Ku data signals are deflected by the reflective filtering means and Ka data signals pass through the reflective filtering means.

In one embodiment the reflective filtering means is formed from a single layer of sheet material. However, more typically, the reflective filtering means is formed from a plurality of layers of differing sheet materials. Typically the specific layers, and arrangement of the same, can vary depending on the specific frequency ranges which are to be received.

In one embodiment at least one of the layers is formed of sheet metal and at least that layer is perforated. Typically the pattern and shape of the perforations are selected with respect to the particular data signal frequency ranges and/or polarisations which are to be received.

In one embodiment the layer or layers of the reflective filtering means is/are encapsulated to improve the ability of the same to withstand external environmental conditions. The encapsulation, and the material used for the encapsulation, can be selected so as to form an effective layer or layers of sheet material of the reflective filtering means in addition to affording environmental protection.

In one embodiment the antenna is provided to receive data signals which can be subsequently processed by apparatus connected to the antenna to allow the user of the apparatus to select television, radio channels and other auxiliary services such as for example, internet broadband services.

In one embodiment, in addition to being able to receive data signals transmitted from one or more satellites, the antenna can be used to transmit data signals from the same to an external location. Typically the data signals are transmitted from the antenna using the Ka band.

Typically the antenna includes a parabolic dish and the reflective filtering means is substantially flat, although curved shapes can be used.

In a further aspect of the invention there is provided a method of receiving data signals at a receiving antenna, said method comprising the steps of receiving data signals at a first frequency or in a first frequency range at a first LNB and data signals at a second frequency or in a second frequency range at a second LNB and wherein reflective filtering means are provided to allow the data signals at the first frequency or in the first frequency range to pass through the same to the first LNB and to deflect the data signals at the second frequency or in the second frequency range to the second LNB.

In one embodiment further LNB's are provided for data signals transmitted at further frequencies or frequency ranges and the respective LNB's are positioned with respect to the said reflective filtering means so as to be optimally positioned to receive their respective deflected data signals.

There is therefore provided in accordance with the invention a satellite antenna which allows data signals at different frequency ranges to be received simultaneously without the need to increase the size of the dish of the antenna and without causing interference between the data signals at the two different frequency, ranges.

A specific embodiment of the invention is now described with reference to the accompanying drawings wherein.

Figure 4A:
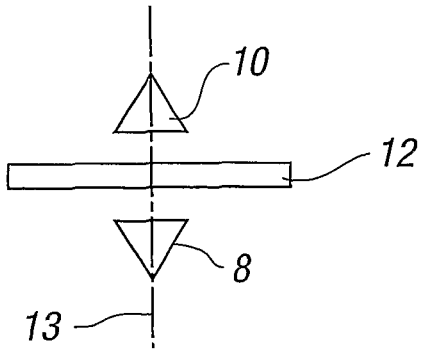
Figure 4B:
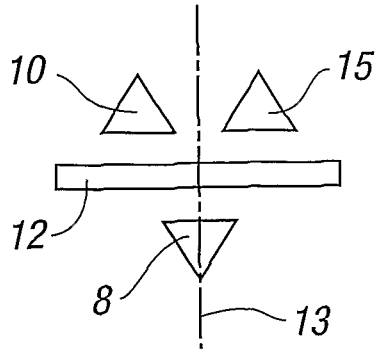
Figure 4C:
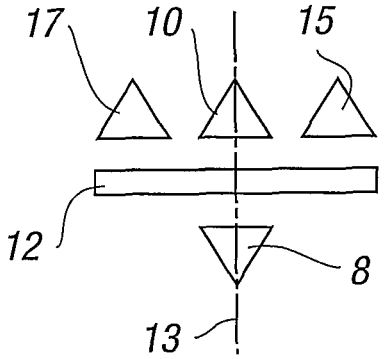
Figure 5:
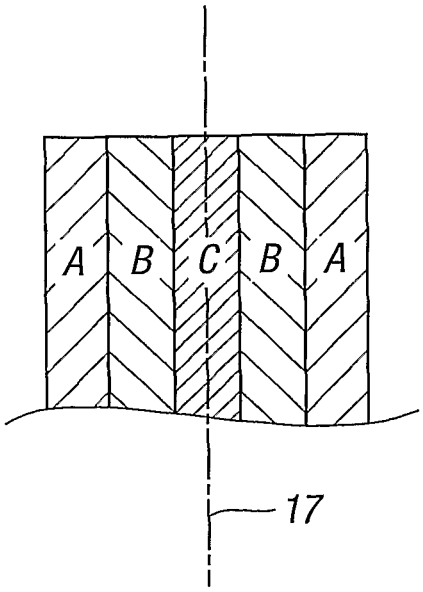

FIG. 4*a-c* illustrate schematically LNB configurations in accordance with the invention; and FIG. 5 illustrates a cross section of the reflective filtering means in one embodiment.

Figure 1:
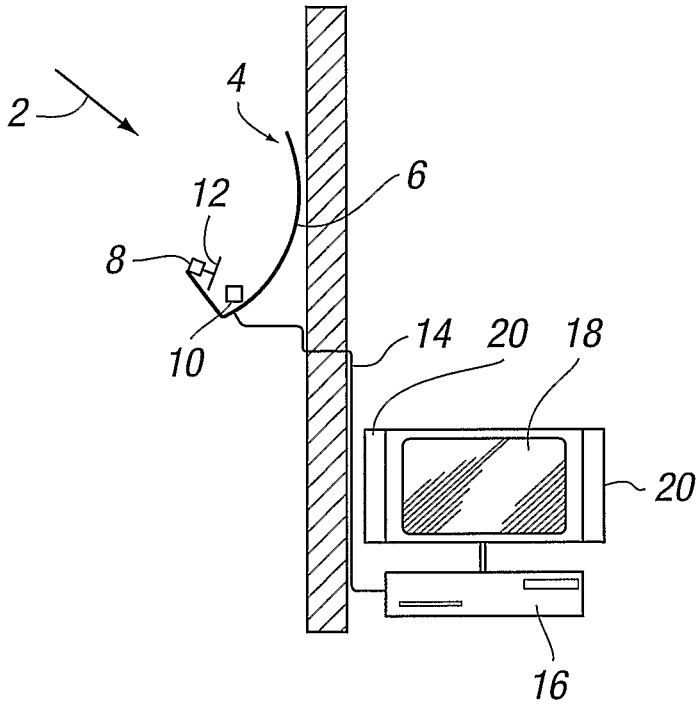
FIG. 1 illustrates a satellite data receiving system in accordance with one embodiment of the invention.

Referring firstly to FIG. 1 there is illustrated a satellite data receiving system with which the antenna of the invention can be used. The data signals 2 are transmitted from one or more satellites (not shown) and are received by a plurality of satellite antennas, mounted at different premises, one of which is shown in this diagram.

The satellite antenna 4 shown includes a parabolic dish 6 and, in this case first and second LNBs 8, 10 which are mounted in a manner which will be described in more details with regard to FIG. 2. Also provided is a reflective filtering means 12 mounted intermediate at least one of the LNBs and the dish. In practice the data signals are received by the satellite antenna LNB's and then passed via a cable connection 14 to processing apparatus (commonly referred to as a set top box) 16 located within the premises. This apparatus decodes the received data and then makes the same available in response to a user selection of a particular radio or television channel or further service which can be displayed to them such as via a display screen and speakers 18,20 connected to the set top box. On occasion it is also possible, or may be required, to transmit data from the set top box and via the satellite antenna.

In this invention there is a requirement to receive data signals transmitted at two different frequency ranges, typically one set of data signals transmitted on the Ka band and the other on the Ku band which are two known frequency ranges used for transmission of data signals from satellites. The Ka band also facilitates the transmission of data from the satellite antenna. In addition to the practical problems of being able to receive the data at the two different frequency ranges the problem of receiving the data signals without interference is also achieved in the current invention so that the quality of the received data is sufficiently good so as to allow the subsequently generated radio and television channels to be of acceptable standard.

Figure 2:
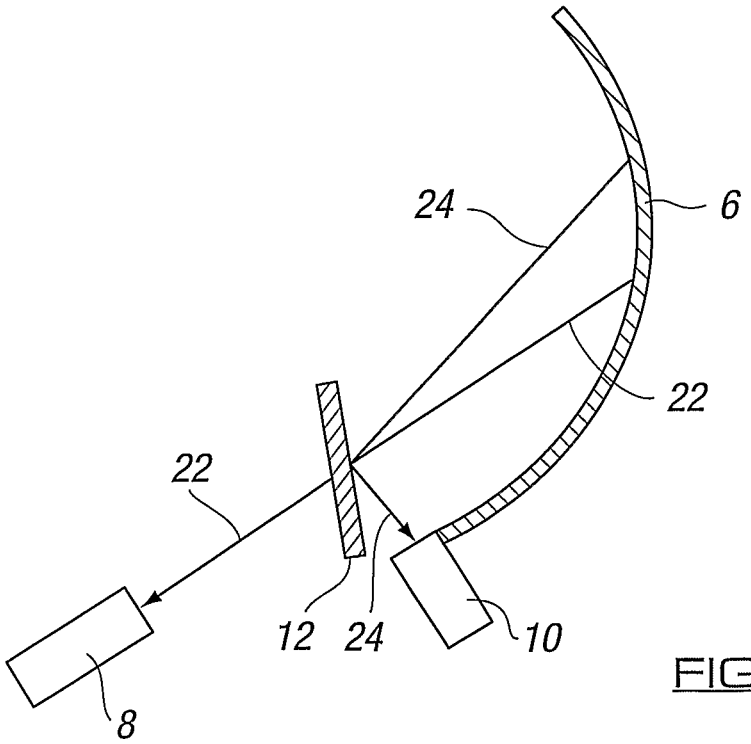
FIG. 2 illustrates in a schematic manner the operation of the antenna with the reflective filtering means.

Turning now to FIG. 2 there is a schematic illustration of the satellite antenna in accordance with one embodiment of the invention. Also illustrated by arrow 22 is the data signal of the Ka band at a first frequency and by arrow 24 the Ku band at a second frequency, both of which are received via the dish 6. Reference to Ka includes both the Ka Tx signal and the Ka Rx signal.

In accordance with this arrangement the reflective filtering means 12 is provided of a form so as to allow the Ka band data signals 22 from the dish 6 to pass through the same and thus reach and be received by the first LNB 8. This LNB is typically mounted in the same position as it would normally be to receive the Ka band data signals without the reflective filtering means being provided. Also, the LNB used can be of a conventional design.

The Ku band data signals cannot be easily received by an LNB at the same location as the Ka band data signal LNB 8 as two LNB's cannot be easily located at the same focal point. This problem is overcome by the current invention by providing the reflective filtering means 12 in a form so as to prevent the Ku band data signals 24 from passing through the same and instead these data signals are deflected by the reflective filtering means 12 as illustrated by arrow 24. The particular path of the deflected data signals can be selected by the suitable positioning of the dish and reflective filtering means such that the deflected data signals 12 pass to a location at which the second LNB 10, is located. Typically the location is selected such that there is no interference between the first and second data signals 22,24.

Figure 3:
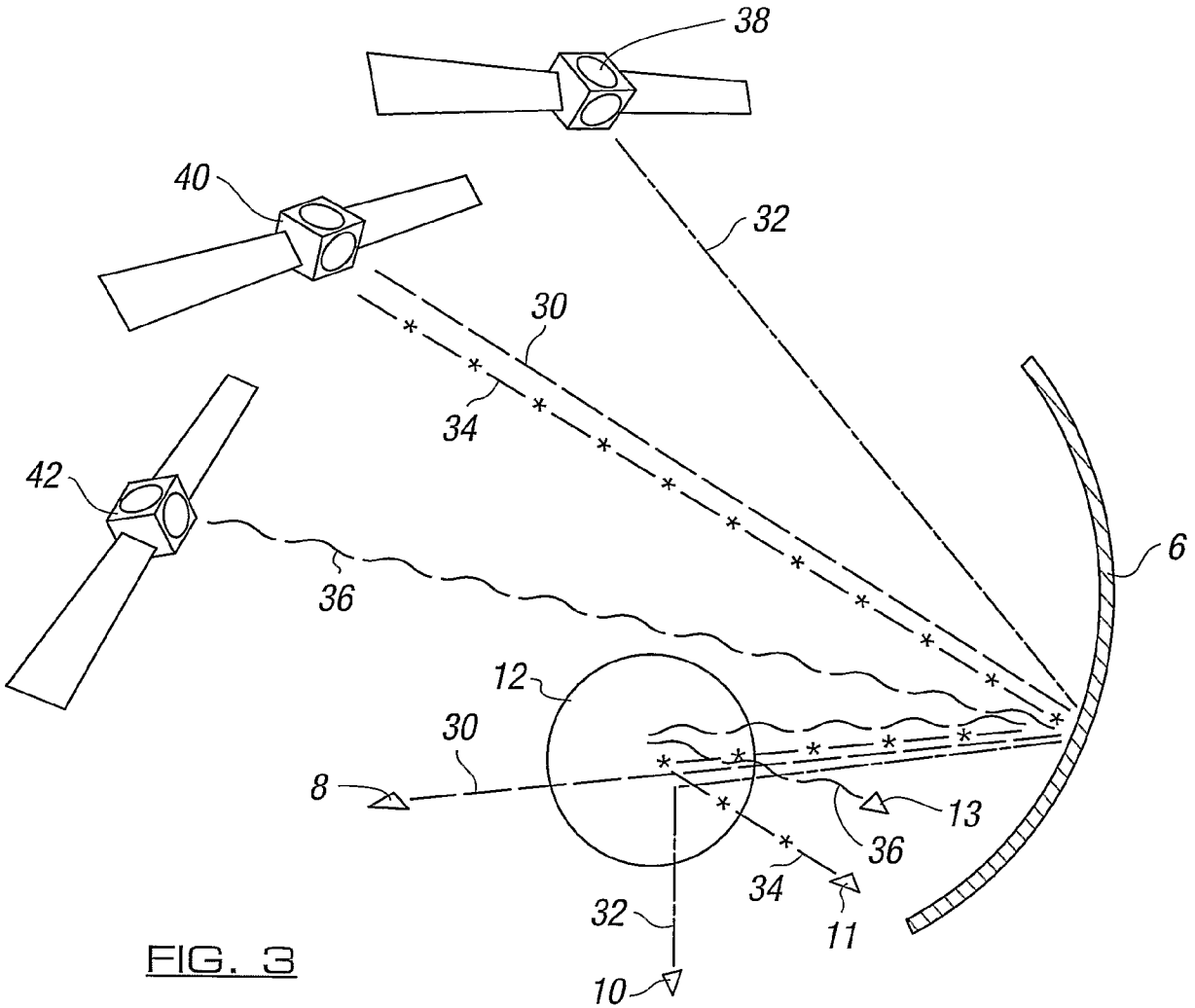
FIG. 3 illustrates a further embodiment of the invention utilising multiple LNBs.

FIG. 3 illustrates the use of multiple LNBs 8, 10, 11, 13 each of which are provided to receive or transmit a particular data signal 30, 32, 34, 36 at particular frequencies respectively. The data signal are transmitted from multiple satellites 38, 40, 42. The data signal paths 30, 32,34,36 show how the signals are sent from the dish 6 to the reflective filtering means 12 which then, depending on the particular data signal frequency, either allows the data signal to pass therethrough or be deflected, as shown. The appropriate LNB's are positioned so as to optimally receive the respective designated data signal with LNB 10 receiving data signal 30 which passes through the filter 12, LNB 10 receiving the deflected data signal 32, LNB 11 receiving deflected data signal 34 and LNB 13 receiving deflected data signal 36. The multiple LNB's are scanned from the FSS focal point. In the design shown, no dispersion is suffered by receiving some signal through the FSS and some directly without having passed through it.

In accordance with the present invention it is proposed that the reflective filtering means 12 is formed from stamped metal film.

FIGS. 4*a-c* illustrate different possible configurations of LNB in accordance with the invention. In FIG. 4*a* the first LNB 8 is shown on a first side of the reflective filtering means 12 and the second LNB 10 is on the other side. In this case the LNB 10 is shown at the centre line 13 of the mounting but could be offset to either side of it to provide optimum receipt of the deflected data signal. In FIG. 4*b* the second LNB 10 is joined by a further LNB 15, and in this case both LNBs are offset from the centre line 13. In FIG. 4*c* a third LNB 17, is provided, with the LNB 10 on the centre line and the LNBs 15 and 17 offset to either side.

In FIG. 5 a cross sectional elevation through a reflective filtering means 12 is shown. In this case the filtering means is formed from sheet material type A, sheet material type B and sheet material type C. It is shown how the sheets of material are arrayed symmetrically about the centre axis 17 with respect to the respective opposing external faces 19, 21 and this provides the desired filtering effect. The specific materials used are selected in order to provide low levels of data loss and the required dielectric properties. It should also be appreciated that the material type A which forms the external faces 19, 21 may also be used as encapsulating means in order to provide protection and resistance to inclement weather conditions.

Thus, by providing the reflective filtering means in accordance with the invention there is provided the ability to receive data signals at two or more distinct frequencies simultaneously without the problems of interference and using conventional LNB's and a common antenna dish.

The invention claimed is:

1. A satellite antenna, said antenna comprising:

first and second low noise blocks provided to receive data signals in first and second frequency ranges respectively; and a reflective filtering means for allowing data signals at a first frequency or in a first frequency range to pass therethrough to the first low noise block and data signals at a second frequency or in a second frequency range to be deflected to the second low noise block respectively wherein the reflective filtering means is formed from a number of layers of differing sheet material, the layers arranged symmetrically in cross section and selected with respect to a predetermined data signal frequencies or frequency ranges which are to be received, and at least one of the layers is perforated.

2. Apparatus according to claim 1 wherein the low noise blocks are positioned to be offset with respect to each other.

3. Apparatus according to claim 1 wherein the second low noise block is mounted at a side or on a center line of the antenna.

4. Apparatus according to claim 3 wherein at least one further low noise block is positioned adjacent at least one of said first and second low noise block.

5. Apparatus according to claim 1 wherein the first low noise block is mounted such that the reflective filtering means lies between the antenna surface and the first low noise block.

6. Apparatus according to claim 1 wherein the reflective filtering means is provided with regard to predetermined data signal frequency ranges which are to be received by the antenna.

7. Apparatus according to claim 1 wherein the reflective filtering means allow the higher value frequency range data signal to pass through the same and the lower value frequency range data signal to be deflected.

8. Apparatus according to claim 1 wherein Ku data signals are deflected by the reflective filtering means and Ka data signals pass through the reflective filtering means.

9. Apparatus according to claim 1 wherein pattern and shape of the perforations are selected with respect to particular frequency ranges and polarizations which are to be received.

10. Apparatus according to claim 1 wherein at least one layer of the at least one layer sheet material of the reflective filtering means is encapsulated.

11. Apparatus according to claim 1 wherein the antenna is provided to receive data signals which can be subsequently processed by apparatus connected to the antenna to allow the user of the apparatus to select television, radio channels and/or other auxiliary services.

12. Apparatus according to claim 1 wherein the apparatus can be used to transmit data signals from the same to a remote location.

13. Apparatus according to claim 1 wherein the antenna includes a parabolic dish and the reflective filtering means is selected from the group consisting of a substantially flat reflective filtering means and a curved filtering means.

14. Apparatus according to claim 1 wherein further low noise blocks are provided for data signals transmitted at further frequencies or frequency ranges and the respective low noise blocks are positioned with respect to the said reflective filtering means to be optimally positioned to receive their respective designated deflected data signals.

15. A method of receiving data signals at a receiving antenna, said method comprising the steps of:

forming a reflective filter means from a number of layers of differing sheet material, at least one of the layers being perforated;

selecting the layers with respect to a predetermined data signal frequencies or frequency ranges to be received;

arranging the layers symmetrically in cross section;

receiving data signals at a first frequency or in a first frequency range at a first low noise block and receiving data signals at a second frequency or in a second frequency range at a second low noise block;

allowing the data signals at the first frequency or in the first frequency range to pass through the reflective filter means to the first low noise block and to deflect the data signals at the second frequency or in the second frequency range to the second low noise block.

16. A method according to claim 15 wherein further low noise blocks are provided for data signals transmitted at further frequencies or frequency ranges and the respective low noise blocks are positioned with respect to said reflective filtering means so as to be optimally positioned to receive their respective deflected data signals.

17. Apparatus for receiving digital data signals at at least two frequency ranges said apparatus comprising:

an antenna provided to receive data signals which are subsequently processed by apparatus connected to the antenna to allow a user of the apparatus to select television, radio channels and/or other auxiliary services, the antenna includes;

a plurality of low noise blocks provided to receive data signals at differing frequency ranges respectively and a reflective filtering means for allowing data signals at a first frequency or in a first frequency range to pass therethrough to a first low noise block and data signals at a second frequency or in a second frequency range and at a third frequency or in a third frequency range to be deflected to second and third low noise blocks respectively, said second and third low noise blocks located intermediate an antenna dish and the reflective filter means.

* * * * *